US005379556A

United States Patent [19]

MacIntyre

[11] Patent Number: 5,379,556

[45] Date of Patent: Jan. 10, 1995

[54] FOLDING GRANDSTAND

[76] Inventor: James R. MacIntyre, 1680 Woodglen La., Altadena, Calif. 91001

[21] Appl. No.: 77,452

[22] Filed: Jun. 17, 1993

[51] Int. Cl.[6] ..... E04H 3/12

[52] U.S. Cl. ..... 52/9

[58] Field of Search ..... 52/9, 10; 472/92

[56] References Cited

U.S. PATENT DOCUMENTS

| | | | |
|---|---|---|---|
| 1,433,547 | 10/1922 | Hadden | 52/9 |
| 2,147,564 | 2/1939 | Vance | 52/10 |
| 2,663,913 | 12/1953 | Mackintosh | 52/10 |
| 2,663,914 | 12/1953 | Mackintosh | 52/9 |
| 2,817,121 | 12/1957 | Mackintosh | 52/9 |
| 3,748,798 | 7/1973 | Mackintosh | 52/10 |
| 4,909,000 | 3/1990 | Mackintosh | 52/9 |

FOREIGN PATENT DOCUMENTS

| | | | |
|---|---|---|---|
| 586263 | 12/1977 | U.S.S.R. | 52/9 |

*Primary Examiner*—Carl D. Friedman
*Assistant Examiner*—Christopher Todd Kent
*Attorney, Agent, or Firm*—Watson, Cole, Grindle & Watson

[57] ABSTRACT

A folding grandstand comprising a supporting frame of forward intermediate and rearward sections hinged together at adjacent ends, vertical support assemblies hinged to the respective sections for supporting the sections on a ground tracks and permitting the grandstand sections to be folded into a collapsed position. The support assemblies comprise continuous trusses permitting the use of fewer pickup points when folding the grandstand along the tracks.

11 Claims, 7 Drawing Sheets 52
51
49
48
47
38
37
36
35
34
33
32
31
62
68
69
71
72
79
83
54
11
12
13
G
T
T1
T2

28
29
26
39
39
31
33
63
53
81
47
34
55
57
59
56
32
67
58
46
42
45
44
72
43
41
64
61
66
62

FOLDING GRANDSTAND

BACKGROUND OF THE INVENTION

This invention relates generally to folding grandstands or bleachers of the type which comprise hinged supporting frame sections carrying seats and footboards and adapted to assume a sloping or inclined position when opened for use or occupancy, but capable of being folded together to occupy a minimum of space at the playing field when collapsed.

Grandstands of this general type are typically comprised of two or three supporting frame sections horizontally hinged together at their adjacent ends by the provision of hinge assemblies between sections to facilitate a folding together of the sections in a fanfold manner.

Prior grandstands of this general type are usually structured in essentially the same manner, i.e., each supporting frame has a deck plate spanning across and supported on longitudinal steel beams. The beams are supported on rolling dolly assemblies when the grandstand is in the stored or folded position and while the grandstand is in transition between the folded and extended positions. The dolly assemblies roll along tracks or troughs that are supported on or in the sport playing field surface below. When the grandstand is in the extended position, ready for use or occupancy, each of the longitudinal beams are supported by the rolling dolly assemblies and each of the longitudinal beams are supported by additional foldable frame assemblies as required to properly support the additional live loads.

Because the underlying dolly assemblies and frame supports are hingedly connected to each of the longitudinal beams of the supporting frame sections, ground tracks are required for each of the dolly assemblies and support frames. These tracks must be installed in the ground for rolling engagement by the dollies prior to extending the grandstand from its collapsed position, and the tracks must be removed from the field after the grandstand is collapsed back to its stored position.

Thus, the number of tracks required for each of the longitudinal beams of the grandstand creates a time and labor intensive operation for assembling and removing tracks each time the grandstand is extended and folded. Also, the storage and handling of a large number of tracks, each comprising several sections, is costly and cumbersome.

Also, each of the many footings on which the tracks are supported are typically covered by continuous grass sod pans after the tracks are removed, such that it becomes costly and labor intensive to remove and replace the sod. And, the sod overlying the many footings can create hazards for the players on the field.

SUMMARY OF THE INVENTION

It is therefore an object of the present invention to provide a folding grandstand generally of the aforedescribed type requiring dolly assemblies and vertical support frames and accompanying tracks but for only alternate longitudinal beams thereby avoiding the need for approximately half the number of tracks previously required for a grandstand which has at least three supporting frame sections hinged together at adjacent ends. This design creates much less disruption to the sport playing field and provides savings in cost, labor and track storage, and avoids some of the hazards in the use of prior grandstand assemblies.

In carrying out this general objective the dolly assemblies and the vertical support frames each comprise a continuous truss hinged to the longitudinal beams and having vertical struts at every other longitudinal beam with the underlying ground tracks located at the vertical struts. Truss diagonals are located between the vertical struts, extending between upper and lower horizontal struts of the truss for transmitting the loads from the intervening longitudinal beams to the ground tracks.

Further in accordance with the invention the tracks are elevated above the sport playing field such that only spaced in-ground track supports need be covered by individual grass sod pans thereby creating less disruption to the sport playing field and minimizing safety hazards for the players.

Other objects, advantages and novel features of the invention will become more apparent from the following detailed description of the invention when taken in conjunction with the accompanying drawings.

BRIEF DESCRIPTION OF THE DRAWINGS

FIG. 16 is a top plan view of a typical adjacent pair of tracks, taken substantially along the line 16—16 of FIG. 7;

DETAILED DESCRIPTION OF THE INVENTION

Figure 1:
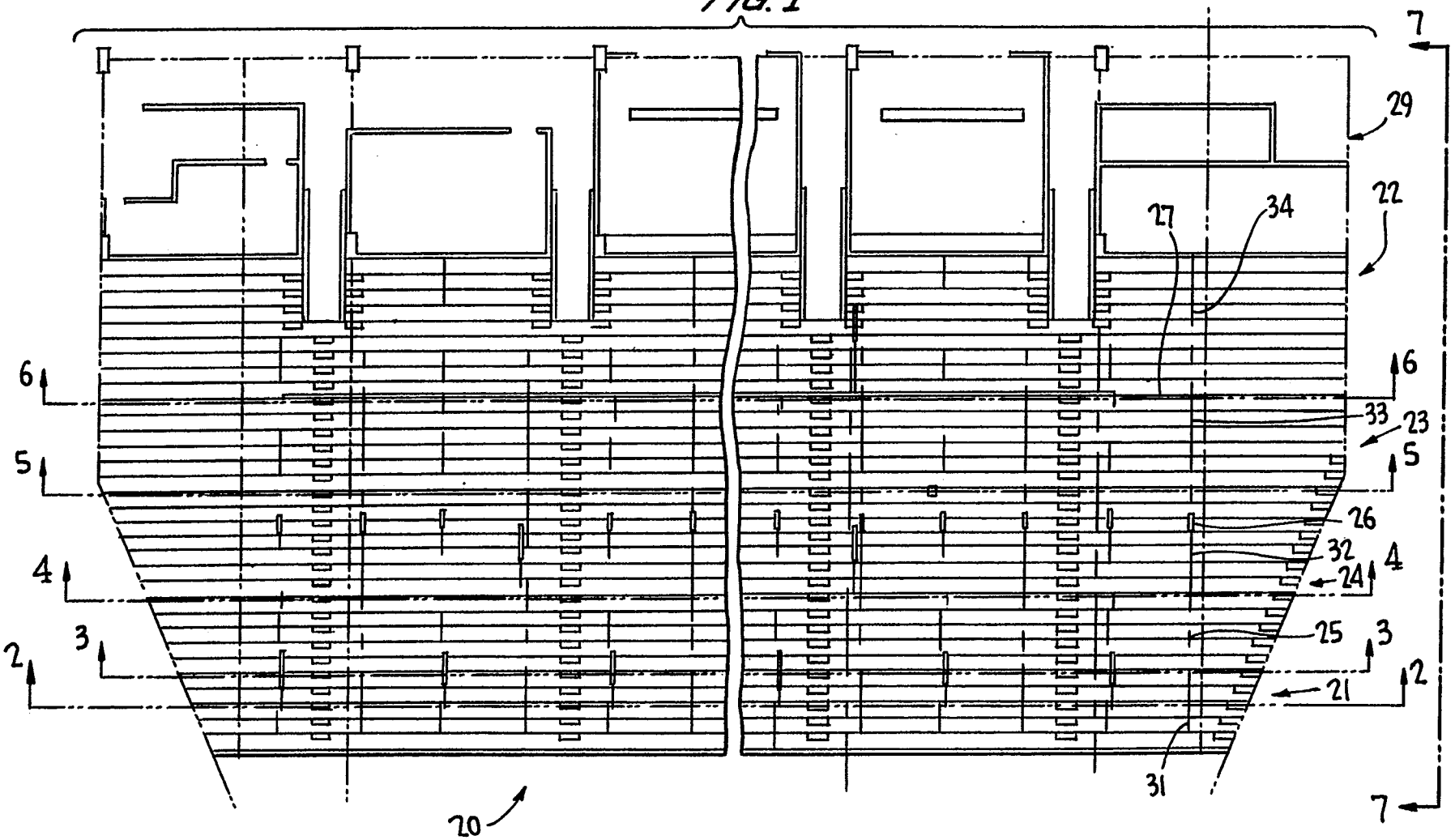
FIG. 1 is a top plan view of a typical grandstand seating system layout with longitudinal beams and supporting structure according to the invention.

Turning now to the drawings wherein like reference characters refer to like and corresponding parts throughout the several views, the grandstand generally designated 20 in FIG. 1 can be constructed as a single monolithic structure such as would occupy the length of a football field, or can be constructed as several tapered sections (not shown) so that they can be configured as "pie" sections around an open circular or oval playing area.

Figure 7:
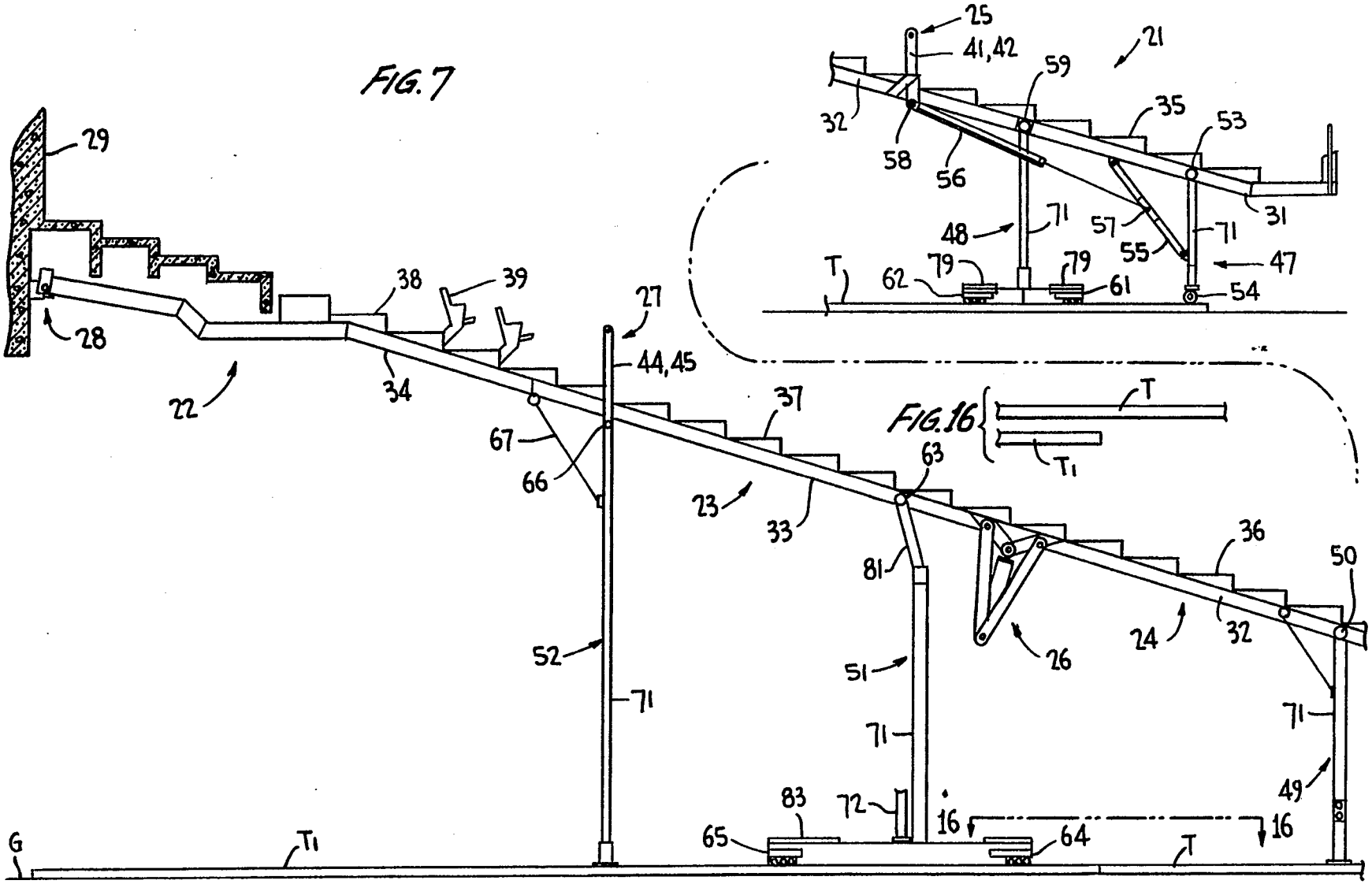
FIG. 7 is an end elevational view of the four-fold grandstand taken substantially along the line 7—7 of FIG. 1.

The grandstand comprises a supporting frame of at least three sections, although four or five or even a greater number of supporting frame sections are possible in the light of the present teachings. For example, FIGS. 1 and 7 illustrate a supporting frame comprising a forward or lower section 21, a rearward or upper section 22, and two intermediate sections 23, 24. Sections 21 and 24 are hinged together at adjacent ends as at 25, sections 23 and 24 are hinged together at adjacent ends as at 26, sections 22 and 23 are hinged together at adjacent ends as at 27, and section 22 is hinged at its free end as at 28 to a permanent wall 29 of the playing field.

Each supporting frame section comprises a plurality of longitudinal beams respectively aligned between sections, such as beams 31, 32, 33, 34 of the respective sections 21, 24, 23, 22.

Upper decks 35, 36, 37, 38 span the beams of the respective supporting frame sections and are welded or otherwise connected to the longitudinal beams thereof. Each of the decks has foot rests and risers to which seats such as 39 may be welded or otherwise connected.

Figure 8:
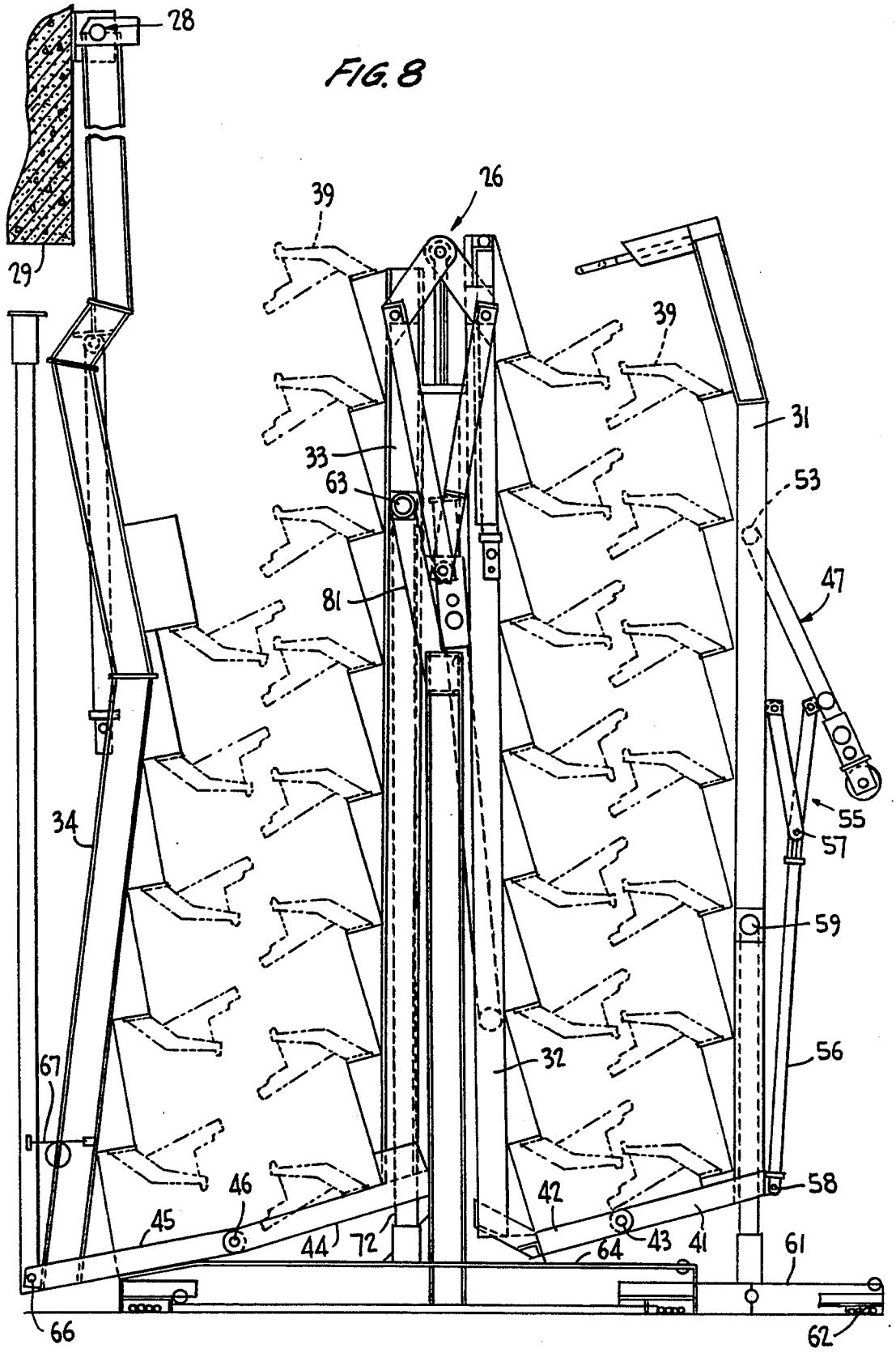
FIG. 8 is a view similar to FIG. 7, at an enlarged scale, showing the grandstand supporting frame in a collapsed condition during storage.

Sections 21 and 24 are horizontally hinged together at their adjacent ends by means of hinge arms 41, 42, as more clearly shown in FIG. 8, respectively secured at one end thereof to the stand sections and hingedly interconnected as at 43.

Stand sections 23 and 24 are horizontally hinged together at their adjacent ends by an assembly of hinge arms and a hydraulically extendable/retractable strut showing in detail in U.S. Pat. No. 4,909,000, commonly owned herewith, the disclosure of which being specifically incorporated herein by reference.

Stand sections 23 and 22 are horizontally hinged together at their adjacent ends by means of hinge arms 44, 45 (FIG. 8) respectively secured at one end thereof to the stand sections and hingely connected as at 46.

Vertical support assemblies 47, 48, 49 hingedly support their respective supporting frame sections on track T located on ground surface G in a manner to be described in detail hereinafter.

Assembly 47 is hinged as at 53 to beams 31 of section 21, the assembly having track engaging rollers 54, and a breakaway strut 55, the arms of which form a knee joint straightened by the provision of a hydraulic extendable/collapsible strut 56 pivoted at opposite ends as at 57, 58.

Support assembly 48 is hinged as at 59 to beams 31, and has a dolly platform 61 at its lower end with track engaging roller 62.

Support assembly 49 is hinged as at 50 to beams 32, and is supported at its lower end on track T.

Support assembly 51 is hingedly connected as at 63 to beams 33, and has a dolly platform 64 at its lower end with roller 65.

Vertical support assembly 52 is hinged as at 66 to beams 34, and is supported at its lower end on track T. A reeled line 67 connects assembly 52 to beams 34 for effecting collapse of assembly 52.

For collapsing the folding grandstand into its FIG. 8 storage position, strut 56 is retracted to break knee joint 55, assembly 49 is collapsed to underlie section 24, the hydraulic struts of hinge assembly 26 are extended for breaking the knee joints between sections 24 and 23, and assembly 52 is collapsed to underlie section 22 upon operation of reel assembly 67, whereupon the four stand sections are fan-folded as shown. When collapsed, dolly section 51 rolls along track T and dolly section 48 rolls along track $T_1$, these two tracks being laterally offset a slight distance as shown in FIG. 16.

The vertical support assemblies 47, 48, 49, 51, 52 will be described with reference to FIGS. 2 to 6. Each of the vertical supports assemblies 47, 48, 49 and 51 supporting the intermediate and forward sections comprise a continuous truss of upper, lower, vertical and diagonal struts interconnected as by welding. Thus, vertical support assembly 47 comprises upper horizontal hollow struts 68 spanning longitudinal beams 31 and hinged thereto as detailed in FIGS. 11 and 12. A solid rod 73 extends through a suitable opening 74 in the web of the longitudinal beam, the rod being welded at opposite ends to end plates 75 welded to struts 68. The apertured beam is reinforced by the provision of plates 76 extending parallel to the beam web and between the beam flanges, the plates being suitably welded to the flanges. Solid rod 73 extends through suitable openings 77 of plates 76, and spacer sleeves 78 covering the solid rod extend between plates 76 and 75, respectively. By such an arrangement, vertical support assembly 47 is hinged to each of the beams 31 with the upper interconnected struts acting as a torsion tube.

Hollow vertical struts 31 are welded to alternate upper struts 68 and each support track engaging roller 54 at the lower end thereof.

Figures 2, 3, 4, 5, 6:
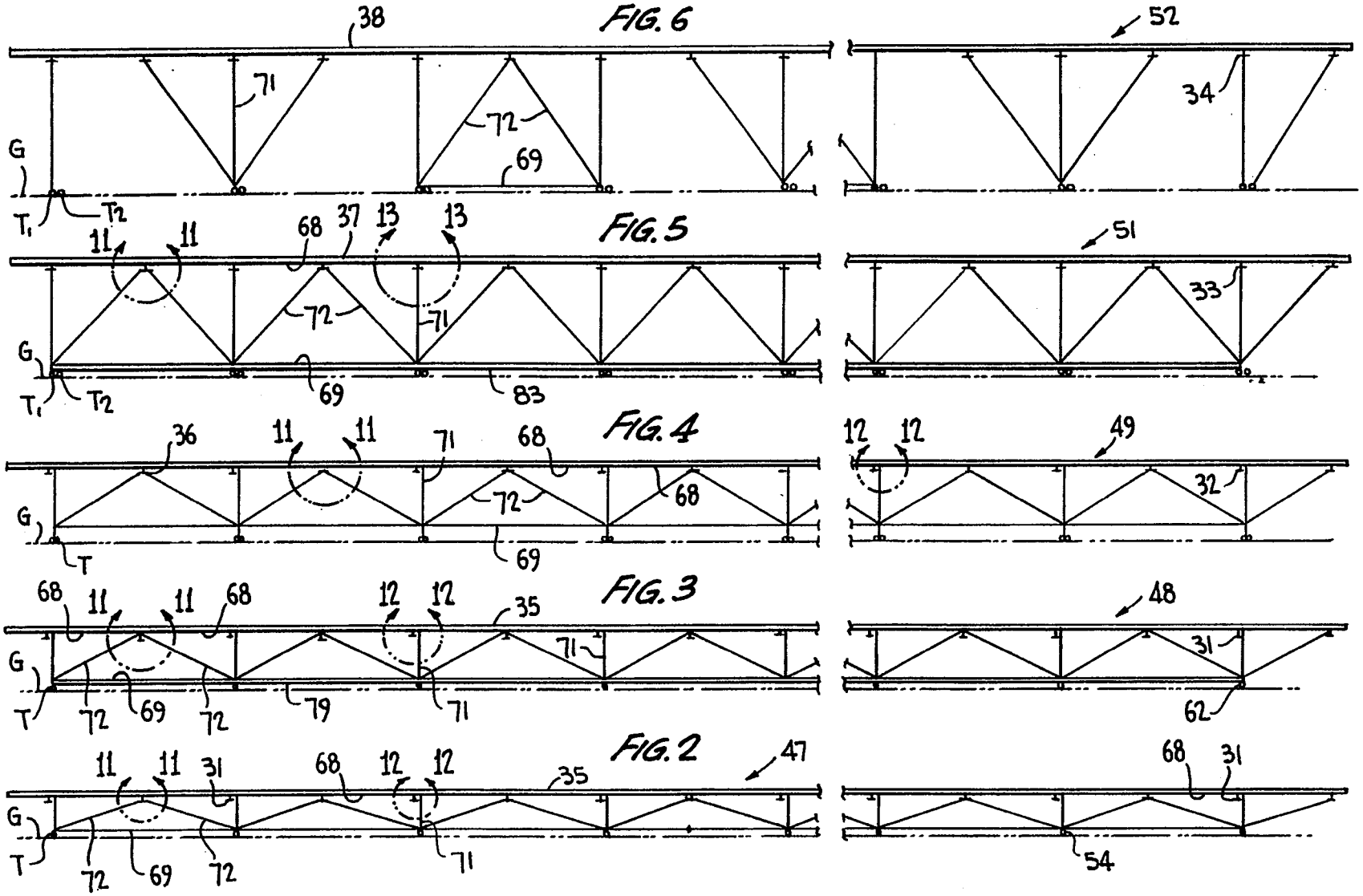
FIGS. 2, 3, 4, 5 and 6 are vertical plan views of the vertical support assemblies for the grandstand sections, taken respectively along the lines 2—2, 3—3, 4—4, 5—5, 6—6 of FIG. 1.
Figure 11:
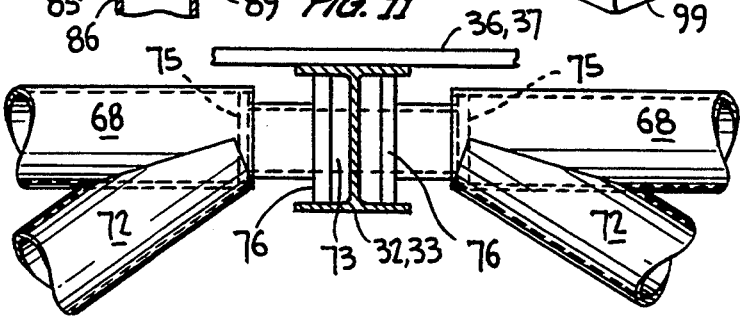
FIG. 11 is detail view of detail 11 of FIGS. 2 to 5, at an enlarged scale.

Hollow diagonal struts 72 slope downwardly in opposite directions from alternative beams 31 as shown in FIG. 2, and as detailed in FIG. 11. The diagonals are welded to the upper struts and are welded to the lower ends of vertical struts 71. Lower struts 69 span between the vertical struts and are welded thereto to complete the truss formation.

By such an arrangement, static and live loads are transmitted directly from each of the beams to tracks T which are located only below alternate longitudinal beams as shown.

Vertical support assembly 48 of FIG. 3 is formed as a truss similar to that described with reference to FIG. 2 except that vertical struts 71 are of greater length compared to struts 71 of assembly 47 and are connected to dolly platforms 61. And, the slope of diagonals 72 of assembly 48 is greater from the horizontal compared to the slope of diagonals 72 of assembly 47. And, cross-braces 79 extend laterally between adjacent dolly platforms 61.

Figure 12:
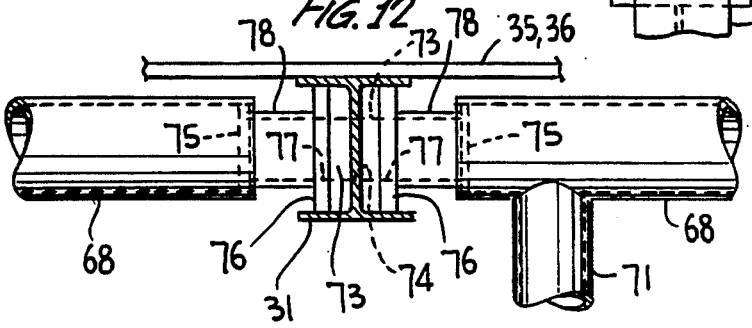
FIG. 12 is detail view of detail 12 of FIGS. 2 to 4, at an enlarged scale.

The details of the hinge joint between the upper struts 68 and the longitudinal beam at the location of the adjoining diagonals shown in FIG. 11 is similar to that described in FIG. 12.

The truss of vertical support assembly 48 is essentially the same as that of the truss described in detail with reference to FIG. 2 except that vertical struts 71 are longer such that the slope of diagonals 72 from the horizontal is greater compared to that of the assemblies 48 and 47. Otherwise, the hinge details shown in FIGS. 11 and 12 apply.

Figure 13:
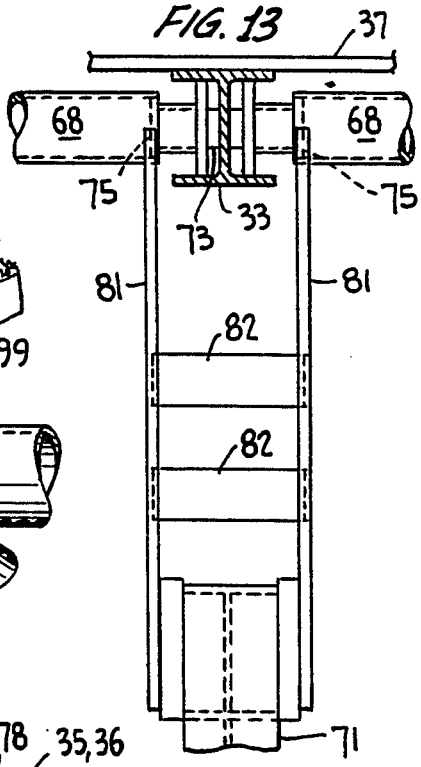
FIG. 13 is detail view of detail 13 of FIG. 5, at an enlarged scale.

For vertical support assembly 51, hinge details of FIG. 11 apply, although the hinge details at the vertical struts are shown in FIG. 13 wherein vertical struts 71 lie directly beneath the alternate longitudinal beams rather than being offset therefrom as in FIG. 12. These vertical struts are supported on dolly platforms 64 in rolling engagement with tracks $T_1$ spaced laterally relative to tracks T shown in FIGS. 2 to 6 and 16, vertical struts 71 of assembly 51 being offset the same distance from struts 71 of assemblies 49, 48 and 47, as shown.

The hinge joint between upper struts 68 and the longitudinal beam is the same as that shown in FIGS. 11 and 12. As shown in FIGS. 7, 8 and 13, support arms 81 extend from vertical struts 71, are cross-braced as at 82, slope slightly rearwardly from the vertical, and are welded to end plates 75 of upper struts 68. Thus, assembly 51 is hingedly connected to beams 33, the rearward slope of support arms 81 allowing for the supporting frame sections to be more tightly collapsed in FIG. 8 by avoiding interference with beams 33, as shown.

The diagonal struts 72 of assembly 51 are, unlike the diagonals of the truss of the assemblies 49, 48, 47, not in the same plane as vertical struts 71 but, as shown in FIGS. 7 and 8, are slightly offset from the vertical struts. The lower ends of the diagonals are welded to dolly platforms 64. And, cross-bracing 83 (FIG. 7) may be provided between adjacent dolly assemblies 64.

Vertical support assembly 52 comprises a structural frame, not in the form of a truss, wherein vertical struts 71 and diagonal struts 72 are directly hinged to beams 34 without the provision of upper struts. Some lower struts 69 may be provided, and vertical struts 71 are supported on tracks $T_1$.

Figure 9:
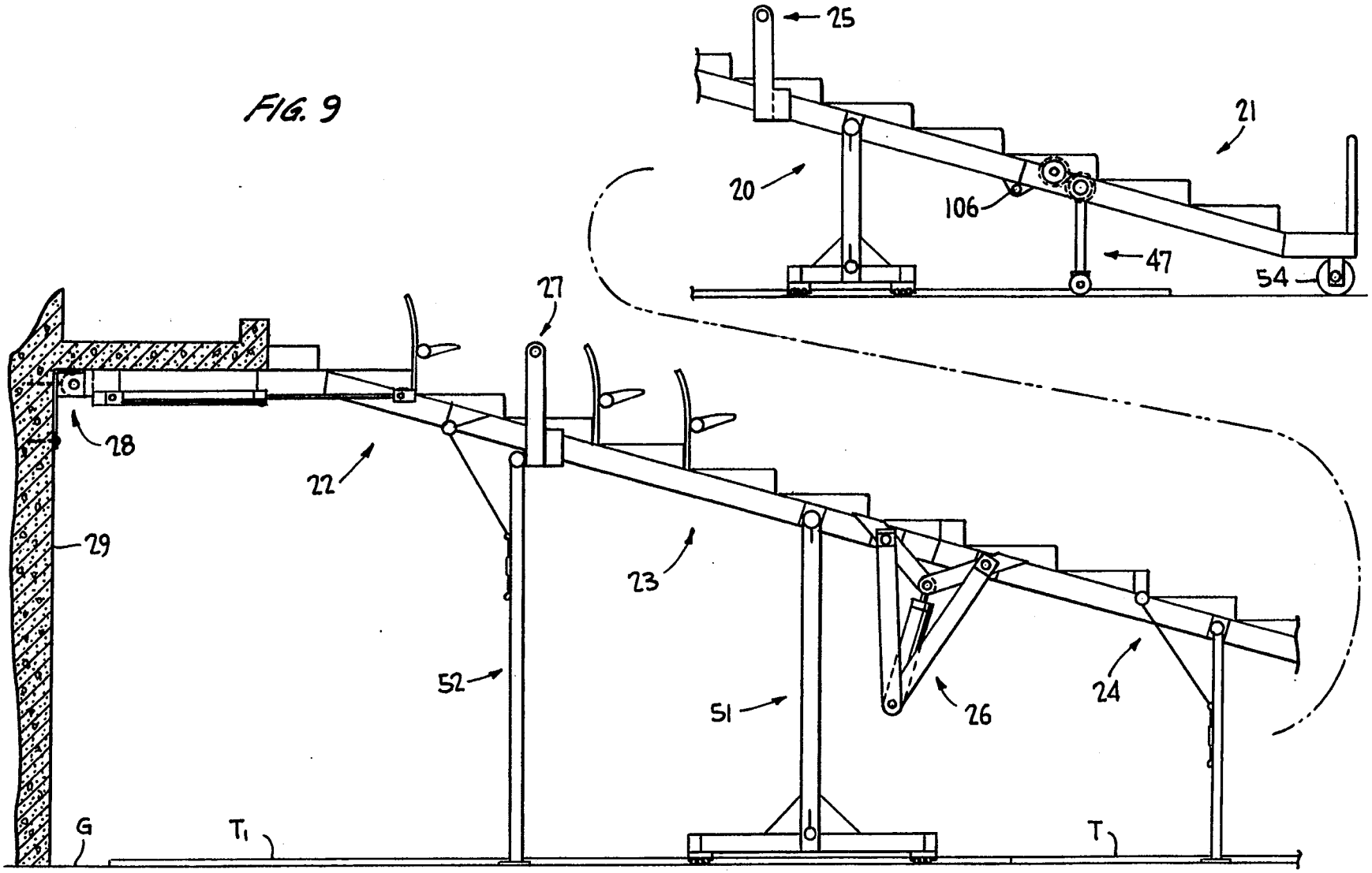
FIG. 9 is a view similar to FIG. 7 of a five-fold grandstand according to the invention, shown in an extended position.
Figure 10:
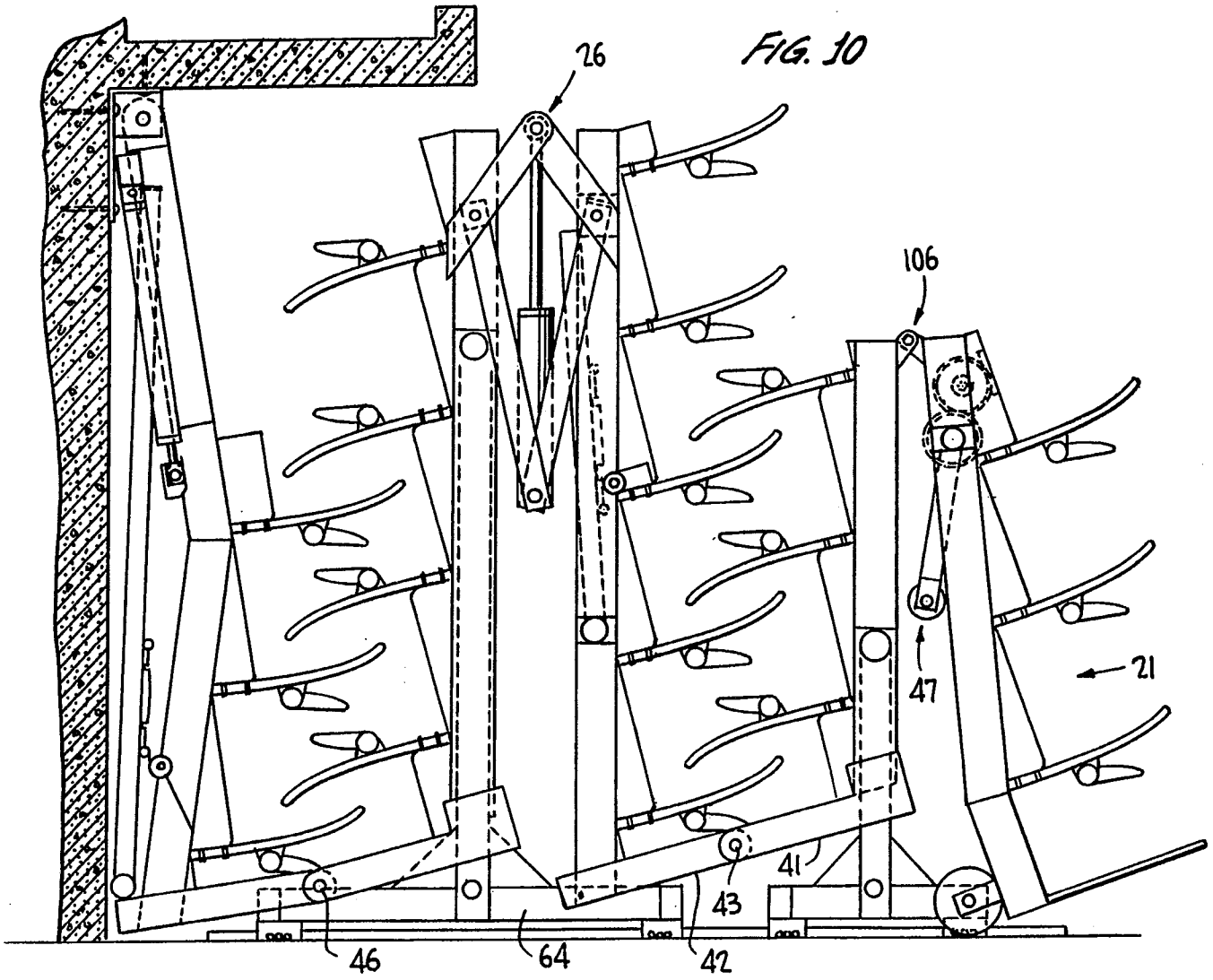
FIG. 10 is a view similar to FIG. 9, at a slightly enlarged scale, showing the supporting frame sections folded into a collapsed, storage position.

FIG. 9 shows a five-fold grandstand comprising forward and rearward sections 21 and 22 and three intermediate sections 20, 23 and 24 all hinged together along adjacent ends and constructed the same as the four-fold grandstand when of FIG. 7 as aforedescribed. FIG. 10 shows the FIG. 9 five-fold grandstand folded into a collapsed position. The five-fold grandstand has horizontal hinges between the sections which are the same as that in FIG. 7, with the addition of a hinge assembly 106 between supporting frame sections 20 and 21.

Also, because of the geometry of the five-fold grandstand, vertical support assembly 51 eliminates the need for support arms such as 81 shown in FIGS. 7 and 8. Instead, the diagonals of the truss forming assembly 51 lie in a common plane with the vertical struts thereof, as shown in FIGS. 9 and 10.

Figure 14:
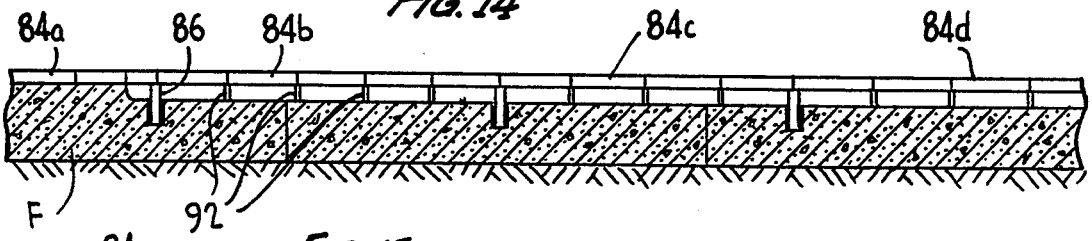
FIG. 14 is an elevational view of a typical track mounted above the ground surface and underlying the dolly and vertical support frames of the supporting grandstand sections, according to the invention.
Figure 15:
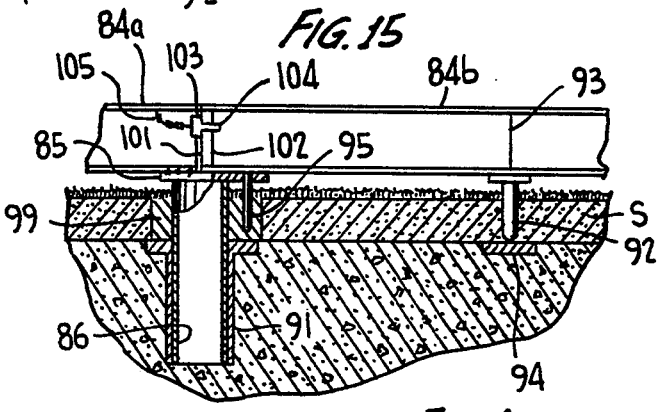
FIG. 15 is a view similar to view 14 at an enlarged scale.

Each of the tracks T and $T_1$ comprise a plurality of aligned track sections 84*a*, 84*b*, 84*c*, etc., shown in FIGS. 14 and 15, which may be in the form of I sections or channel sections, or the like. One end of each track section (FIGS. 15, 15A) has an underlying support plate 85 welded or otherwise affixed thereto. A short, hollow support post 86 depends from plate 85 and is welded or otherwise affixed thereto. The centerline of post 86 is aligned with an end wall 87 of track section 84*a*. And, plate 85 extends beyond this end wall and beyond post 86 to form an extension 88 having a guide opening 89.

Concrete footings F are provided beneath the tracks T and $T_1$, and support sleeves 91 are anchored in the concrete footing at a spaced distance equal to the length of a typical track section.

A plurality of support pins 92 are spaced apart between opposite ends of the track sections and are affixed as by welding to an underside thereof. Support plates 93 or the like may be provided between flanges of the track sections at the locations of pins 92.

Support pads 94 are anchored in the concrete footing at spacings equal to the spacings of pins 92.

Figure 17:
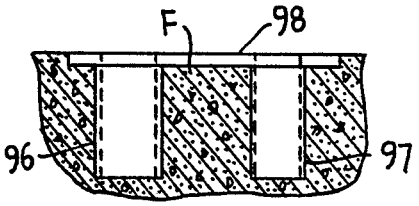
FIG. 17 is a typical ground receptacle in which the adjacent pair of tracks of FIG. 16 are supported.
Figure 15A:
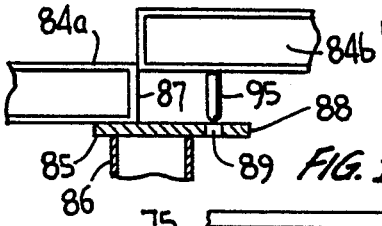
FIG. 15A is a view similar to FIG. 15 showing the manner of assembling the track sections.

Ends of the track sections adjacent guide plates 85, such as track section 84*b* of FIG. 15A, are each provided with a guide pin 95 depending from and affixed to an underside of the track section, in alignment with guide opening 89.

Where track sections T and $T_1$ are side-by-side (FIGS. 5, 6, 7, 16), a pair of support sleeves 96, 97, interconnected by plate 98, as shown in FIG. 17, are anchored in the concrete footing for the reception of support posts 86 as in the manner aforedescribed.

Figure 18:
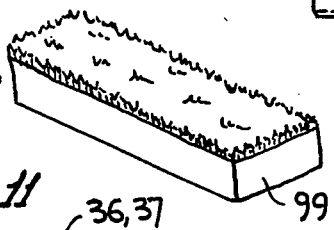
FIG. 18 is a perspective view of a typical grass sod pan used to cover the spaced track ground supports after removal of the tracks.

The footings are covered with sod S, and sod pans 99 (FIG. 18) cover each of the support sleeves 91, as well as 96, 97, as when the grandstand is collapsed and folded into its FIG. 8 position.

Before unfolding the grandstand to its in use position of FIG. 7, sod pans 99 are removed along the footings, and the track sections are installed starting with the rearwardmost track section such as track section 84*a* wherein support post 86 is extended into support 91. The next track section, such as 84*b*, is then lowered in the direction of the arrow of FIG. 15A such that guide pin 95 extends through guide opening 89. Support pins 92 are simply impaled through sod S, and track sections 84*c*, 84*d*, etc. are similarly installed.

To assure proper alignment, the adjacent ends of the track sections may be provided with end plates 101, 102, plate 101 having a retainer cup 103, and plate 102 having a suitable opening through which a pin 104 supported on a short chain 105 extends for positively aligning the track sections together.

The track sections of both tracks T and $T_1$ are assembled as aforedescribed.

After the grandstand is folded back into its FIG. 8 position, the track sections are simply removed one at a time, and the sod pads 99 are replaced over support sleeves 91 in readiness for use of the playing field now exposed upon the folding of the grandstand.

Support posts 86 are sufficiently long to maintain the tracks slightly elevated above the playing surface field, as shown in FIG. 15. And, since the tracks underlie only alternate longitudinal beams as aforedescribed, a fewer number of tracks are required without any sacriface in safety or structural integrity of the folding grandstand.

Obviously, many modifications and variations of the present invention are made possible in the light of the above teachings. It is therefore to be understood that within the scope of the appended claims the invention may be practiced otherwise than as specifically described.

What is claimed is:

1. A folding grandstand comprising, a supporting frame comprising at least a forward, an intermediate and a rearward section hinged together at adjacent ends thereof, the frame adapted when opened for use to occupy a plane of gradual inclination to the horizontal, each of the frame sections comprising a plurality of transversely spaced longitudinal support beams and an upper occupant supporting deck surface mounted on the beams, the respective beams of all the frame sections being in alignment, vertical support means hingedly supporting each of the respective sections on a ground surface, means hingedly supporting an upper end of the rearward section to an upstanding wall, the vertical support means supporting the rearward section comprising a structural frame, the vertical support means supporting the intermediate and forward sections each comprising a continuous truss hinged directly to said longitudinal beams, each said truss comprising interconnected upper, lower, vertical and diagonal struts, the upper struts spanning the longitudinal beams, the vertical struts extending only from a first set of alternating longitudinal beams, the lower struts extending between the vertical struts, and pairs of the diagonal struts sloping from a second set of remaining alternating longitudinal beams respectively toward lower ends of the vertical struts, the vertical struts being supported on tracks located on the ground beneath only the first set of alternating beams, at least one of the vertical support means comprising a dolly assembly having platform sections with track engaging rollers, whereby static and live loads acting on the deck surfaces of the sections are transmitted via all the longitudinal beams directly to the underlying tracks thereby avoiding the need to transmit the loads vertically from the second set of beams to any other tracks which would otherwise become necessary.

2. The grandstand according to claim 1, wherein the supporting frame comprises two intermediate sections hinged together at adjacent ends thereof and at adjacent ends of the forward and rearward sections.

3. The grandstand according to claim 2, wherein two of the vertical support means each comprise said dolly assembly in rolling engagement with said tracks.

4. The grandstand according to claim 1, wherein the supporting frame comprises three intermediate sections hinged together at adjacent ends thereof and at adjacent ends of the forward and rearward sections.

5. The grandstand according to claim 4, wherein two of the vertical support means each comprise said dolly assembly in rolling engagement with said tracks.

6. The grandstand according to claim 1, wherein solid rods interconnect adjacent ends of the upper struts, the rods extending through openings provided in the longitudinal beams to thereby directly hinge each of the trusses to the beams.

7. The grandstand according to claim 1, wherein each of the tracks comprises a plurality of track sections arranged end-to-end, cooperating guide means provided at adjacent ends of the sections for aligning the track sections of each track relative to one another.

8. The grandstand according to claim 7, wherein the guide means comprise a guide plate fixed to an underside of one of the track sections and extending beyond an end thereof, an adjacent track section having a depending guide pin at an end thereof extending through a guide hole provided in said guide plate for aligning the track sections.

9. The grandstand according to claim 8, wherein a support post depends from the guide plate for insertion into a concrete embedded support sleeve located in the ground, the support post underlying the ends of the one and the adjacent track sections.

10. The grandstand according to claim 8, wherein each of the track sections has depending support pins fixed to an underside thereof and spaced along the track section between opposing ends thereof, the pins bearing against concrete anchored support pads located in the ground.

11. The grandstand according to claim 9, wherein the support posts of each of the track sections is of a predetermined length for elevating the track sections above the ground surface to permit grass to grow beneath the track sections.

* * * * *